United States Patent [19]

Ashley et al.

[11] Patent Number: 4,516,298

[45] Date of Patent: May 14, 1985

[54] CANE SINGEING APPARATUS

[75] Inventors: John C. Ashley; Bernard Calhoun, both of Lansing, N.C.

[73] Assignee: Armstrong World Industries, Inc., Lancaster, Pa.

[21] Appl. No.: 564,035

[22] Filed: Dec. 21, 1983

[51] Int. Cl.[3] ..... D06C 9/02

[52] U.S. Cl. ..... 26/3; 28/174

[58] Field of Search ..... 26/3; 28/174, 239; 432/8, 59

[56] References Cited

FOREIGN PATENT DOCUMENTS

| | | | |
|---|---|---|---|
| 37-2144 | 5/1962 | Japan | 26/3 |
| 4223 | of 1876 | United Kingdom | 26/3 |
| 151666 | 3/1962 | U.S.S.R. | 26/3 |

*Primary Examiner*—Robert R. Mackey

[57] ABSTRACT

An apparatus is provided for singeing cane material to remove the protruding cane fiber that naturally exists with cane material. Cane is moved through gas flames which singe or burn off the cane fibers while leaving the basic cane body undamaged by the flames.

1 Claim, 2 Drawing Figures

CANE SINGEING APPARATUS

BACKGROUND OF THE INVENTION

1. Field of the Invention

The invention is directed to a singeing apparatus and, more particularly, an apparatus for singeing chair cane material.

2. Description of the Prior Art

Singeing apparatus and singeing techniques have been used in many arts and are probably best known to most people for the purpose of singeing pin feathers from fowl.

In the furniture business, protruding cane fibers are normally removed from a woven chair cane seat by hand sanding.

SUMMARY OF THE INVENTION

The invention is directed to an apparatus for singeing cane material. A table structure is provided and in the surface of the table structure there are several recesses. Cane is dispensed from a recess in one end of the table and passes through a set of drive rolls positioned in another recess in the table. The drive roll then moves the cane past two additional recesses that have gas manifolds therein with a gas flame protruding above the top of the recess. As the cane passes across the gas flame, the excess or protruding cane fibers are singed off the woven cane seat. The processed cane is held by hold down rolls where necessary and is finally moved into a recess for roll up for subsequent processing and application to chairs.

DESCRIPTION OF THE PREFERRED EMBODIMENT

Figure 1:
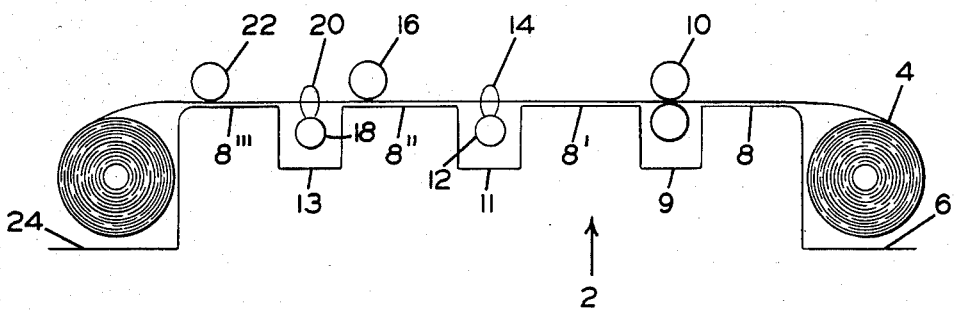
FIG. 1 is a schematic view of the apparatus herein.

The invention is an apparatus for singeing cane material and it is shown in FIG. 1 wherein numeral 2 represents the apparatus. The apparatus constitutes a table structure which has an upper work surface 8 and this work surface is identified by the numerals 8, 8', 8'' and 8'''. Several recessed areas 9, 11 and 13 are provided in the upper work surface 8 of the table. At one end of the table, there is a receiving department 6 and positioned in the receiving department 6 is the cane material 4 which has been woven in a pattern and will subsequently be cut into pieces to be used to form chair cane seats.

In the first recess of the table, adjacent the dispensing compartment 6, there is a dual roll drive means 10. The drive means is so positioned so that the lower surface of the upper roll and the upper surface of the lower roll define a nip therebetween and this nip is positioned in the plane of the upper work surface of the table. The two rolls make contact at the nip and are conventionally resiliently mounted so that the cane material 4 may be slipped between the nip of the rolls and then the rolls themselves may grip the cane material and move it across the upper work surface 8 of the table.

Adjacent the drive means 10 there is a second recess 11 and in this recess, below the upper surface of the table, is positioned a gas manifold 12. The manifold has a flame 14 exiting from the upper surface thereof and this extends to slightly above the upper surface 8 of the table. Consequently, any cane material moving along the plane of the upper surface 8 of the table will have to pass through the flame 14. The surface 8' is nothing more than an extension of the table surface 8. Surface 8' is positioned between roll means 10 and the first flame 14. Beyond flame 14 there is another portion 8'' of the upper work surface of the table. Positioned on this surface is a hold down roll 16 which simply keeps the cane resting against the upper work surface 8'' of the table.

A third recess 13 is provided and in this recess is a gas manifold 18 and a flame 20 which operate the same way as flame 14. Consequently, the cane is subjected to two singeing operations. Beyond the recess 13 there is another portion 8''' of the upper work surface of the table. Here another hold down roll 22 may be used to hold the cane down against the surface 8'''.

Finally, the cane moves into a receiving compartment 24 in which the cane is rolled up so that it may be stored for future use as a chair seat.

Figure 2:
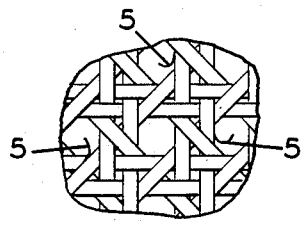
FIG. 2 is a top view of a woven cane fabric.

The cane material is shown in part in FIG. 2 and it is woven in the conventional manner of chair cane seats. Cane material is a flat strand material that is really formed from a plurality of fibers. Particularly along the ends of the strands and the sides of the strands of the cane sometimes fibers will tear loose and project from the body of the cane material. When cane material is used in a chair, it is provided with some type of coating and this coating tends to stiffen the cane fibers that are projecting from the cane material. This established a number of stiff protrusions which can project into your skin if you rub your hand across the cane material or if you sit on the cane material. Removal of these fibers, which are shown by numeral 5 in FIG. 2, would be desirable to have a smooth surface cane material for use as a seat. The singeing steps of the above-described apparatus remove these projections 5 by, in effect, burning off the projections without burning the main part of the cane strand. The operation is no different than the singeing of pin feathers from a chicken where the pin feathers are burned off, but the chicken skin is untouched by the singeing flame. The flame produced is a conventional gas flame which extends up approximately $1\frac{1}{2}$ inch from the manifold and approximately $\frac{1}{2}$ inch above the upper surface 8 of the table. The flame is very comparable to the flame that you normally encounter in a typical gas range in the home. The cane is moved at a speed of approximately 28 feet per minute and this movement is sufficient to permit the gas flame to burn off the protrusions 5, but in no way, damage the main cane strand which forms the woven cane structure for a chair seat.

What we claim is:

1. In an apparatus for singeing cane material, the structure comprising:

(a) a table structure with an upper work surface, several recessed areas in the upper work surface, and a dispensing compartment at one end of the table with a receiving compartment at the other end of the table, (b) in one recess of the table adjacent the dispensing compartment, a dual roll drive means is positioned with the lower surface of the upper roll and the upper surface of the lower roll defining a nip and the nip being positioned in the plane of the upper work surface of the table, (c) adjacent the drive means in another recessed area of the table, a gas manifold is positioned below the surface of the upper work surface of the table, (d) a second gas manifold in position in another recessed area with a section of the upper work surface positioned between the two recessed areas having the gas manifolds, and (e) two hold down roll means resting on the upper work surface adjacent the recess with the second manifold means whereby a chair cane seat may be moved from the dispensing compartment by the drive means and slipped along the upper work surface of the table through flames generated by the first and second manifolds to singe protruding cane fiber and remove the protruding cane fiber from the body of the chair cane seat prior to the time the chair cane seat is rolled up in the receiving compartment.

* * * * *